US009617733B2

(12) United States Patent
Grisé et al.

(10) Patent No.: US 9,617,733 B2
(45) Date of Patent: Apr. 11, 2017

(54) CURTAIN WALL ELEMENTS

(71) Applicant: A. & D. PREVOST INC., Richelieu (CA)

(72) Inventors: Jocelyn Grisé, Richelieu (CA); Olivier Laurin, Richelieu (CA)

(73) Assignee: A. & D. PREVOST INC., Richelieu (CA)

( * ) Notice: Subject to any disclaimer, the term of this patent is extended or adjusted under 35 U.S.C. 154(b) by 0 days.

(21) Appl. No.: 14/529,932

(22) Filed: Oct. 31, 2014

(65) Prior Publication Data

US 2016/0069073 A1 Mar. 10, 2016

(30) Foreign Application Priority Data

Sep. 9, 2014 (CA) ..... 2863016

(51) Int. Cl.

| | |
|---|---|
| ***E04C 3/04*** | (2006.01) |
| ***E04B 2/96*** | (2006.01) |
| ***E04B 1/68*** | (2006.01) |
| ***E04B 1/76*** | (2006.01) |
| ***E04B 1/78*** | (2006.01) |
| ***E06B 7/14*** | (2006.01) |

(52) U.S. Cl.

CPC ..... *E04B 2/965* (2013.01); *E04B 1/6801* (2013.01); *E04B 1/762* (2013.01); *E04B 1/78* (2013.01); *E04B 2/967* (2013.01); *E06B 7/14* (2013.01); *E04C 2003/0439* (2013.01); *E04C 2003/0465* (2013.01); *E06B 2007/145* (2013.01)

(58) Field of Classification Search

CPC ... E04B 2/96; E04B 2/967; E04B 2/90; E04B 2/965; E04B 1/6801; E04B 1/762; E04B 1/78; E06B 3/5427; E06B 2003/26392; E06B 7/14; E06B 2007/145; E04D 2003/0806; E04D 13/0445; E04C 2003/0465; E04C 2003/0439

See application file for complete search history.

(56) References Cited

U.S. PATENT DOCUMENTS 4,448,001 A * 5/1984 Whitmyer ..... E06B 7/14 52/209
5,618,593 A * 4/1997 Belser ..... B29C 47/003 428/121

(Continued)

FOREIGN PATENT DOCUMENTS

GB 2176217 A * 12/1986 ..... E04B 2/965

*Primary Examiner* — Phi A
*Assistant Examiner* — Omar Hijaz
(74) *Attorney, Agent, or Firm* — Marshall, Gerstein & Borun LLP

(57) ABSTRACT

A curtain wall structure that can provide a continuous sealing plane through the use of a dual density gasket and that offers improved sealing and thermal insulation properties. The curtain wall structure also provides a structural reinforcement element assembly that is integrated into a mullion of the curtain wall structure to provide a better load bearing capacity. A curtain wall water drainage cross element assembly is also provided to prevent water from flowing vertically inside the curtain wall system. An expansion joint assembly is also provided and designed as two movable parts allowing provides a sound free vertical displacement of components by means of no direct metal to metal contact between sliding parts.

29 Claims, 5 Drawing Sheets

(56) References Cited

U.S. PATENT DOCUMENTS

| | | | | |
|---|---|---|---|---|
| 8,225,561 | B2 * | 7/2012 | Voegele, Jr. | E04B 2/967<br>52/204.5 |
| 2006/0201084 | A1 * | 9/2006 | Arias | E04B 2/965<br>52/235 |
| 2014/0138919 | A1 * | 5/2014 | Barrall | F16J 15/02<br>277/590 |
| 2015/0284951 | A1 * | 10/2015 | Frederick | E04B 2/965<br>52/235 |

* cited by examiner

CURTAIN WALL ELEMENTS

FIELD OF THE INVENTION

The present invention relates to wall structures and more particularly to a method of assembling and/or sealing curtain wall structures. There is also provided a method for draining curtain wall structures and a method for providing compartmentation resulting in pressure equilibration within each of the curtain wall glazing cavities and the outside.

BACKGROUND

In most forms of curtain wall constructions, the prevention of water and water vapor penetration and interior collection of moisture due to internal condensation have presented challenges for various elements of the curtain wall system.

Sealing

Sealing elements or gaskets in curtain wall constructions usually include either extruded or molded parts made from a wide variety of compounds (for example EPDM rubber, PVC, Silicone, or TPE) that require the application of an additional sealant in order to complete sealing of the curtain wall aluminum structure at the joint interfaces and in order to also provide a continuous seal between the numerous sealing elements. Up to now, EPDM foam is typically used for thermal insulation and for not for sealing.

Sealing elements are usually small and seal the perimeter of a single glazed windows to both (two sealing elements are installed per curtain wall).

In curtain wall structures, the sealing plane is typically made up of layered materials, for example the inside surface of the glass pane—gasketing material—the aluminum profile of the curtain wall structure, a pattern that repeats itself for each daylight opening in the frame. Variations in the arrangement of the components can be observed depending on the conditions in which the curtain wall is used.

Moreover, conventional curtain walls use a liquid sealant (for example butyl, silicone) to ensure sealing of aluminum parts between themselves and to ensure sealing of non-continuous gaskets between themselves and to the aluminum. Furthermore, expansion joints also require a liquid sealant to prevent any leakage.

Thermal Insulation

In typical curtain wall constructions, thermal insulation is provided by a rigid or semi-rigid barrier made of PVC (Polyvinyl chloride), polyamide, EPDM (ethylene propylene diene monomer), TPE (thermoplastic elastomer), Nylon 66 (isobar) or any other insulating material for example. EPDM foam is sometime used between two sealed elements of the wall, such as the mullion and an outside element (such as a pressure plate or rail) holding the glass pane to the mullion, but never in front and behind the elements. Furthermore the size of the thermal insulation elements is usually small and does not cover up the structural mullion, nor the glass retaining element surfaces.

Standard curtain walls can also have components screwed directly into the thermal barrier between two sealed elements.

Steel Reinforcement

Steel reinforcements in curtain walls are typically floating upon insertion in the aluminum profile of the mullion body, and are typically mechanically fastened to the mullion on a hidden face only, or on a bracket or shear block.

Water Drainage of Cavities at Each Daylight Opening

To ensure proper control of any water within the system and to apply a rainscreen principle, water collected within the system must be compartmented at each daylight opening and drained to the outside at each location. Moreover there must be a means of letting air flow from the outside to the drained cavity to ensure proper pressure equilibrium and to facilitate expulsion of any water from the cavity to the outside.

Expansion Joints

Standard curtain wall systems allow for a vertical displacement ranging from ⅛ inch to ½ inch and the movement is taken up by a gap between to vertical elements that are mechanically kept aligned and the movement is taken up by a gap between two vertical elements that are kept aligned with an internal sleeve or an external guide. The continuity of the sealing plane is usually obtained by means of an on-site applied sealant between the adjacent mullions. The discontinuity of the glass retaining element (pressure plate or rail) is also present at this location but can be staggered from the inside mullion joint. Often, expansion joints do not offer any thermal break structure. Moreover, conventional expansion joints have no system for a temporary installation locking system for ease of installation. Additionally, standard expansion joints need liquid sealants for sealing.

There is therefore a need for curtain wall elements that address at least one of the above-mentioned disadvantages associated with conventional curtain wall elements.

SUMMARY

It is therefore a general object of the present invention to provide a curtain wall design that addresses at least one of the above-mentioned needs.

According to the invention, there is provided a curtain wall structure comprising:

- at least one first-type mullion comprising:
  - a mullion base structure;
  - a structural reinforcement element positioned within the mullion base structure; and
  - at least one profiled rod element retaining the structural reinforcement element with respect to the mullion base structure; and
- at least one second-type mullion comprising:
  - a gasket for mounting glass panels of the curtain wall structure, the
- gasket being formed from a dual density rubber compound;

wherein each mullion of a curtain wall daylight opening comprises a water drainage cross element assembly, the cross element assembly comprising:

- a first cross subelement;
- a second transverse cross subelement positionable over the first cross element;
- an elastomeric element positionable over the first and second cross subelements;
- a cross pressure strip positionable over the elastomeric element; and
- a fastening mechanism for fastening the first and second cross subelements, the elastomeric element and the pressure strip together, the pressure strip exerting pressure over the elastomeric element and forming a sealed assembly.

In some embodiments, the curtain wall structure further comprises an expansion joint assembly, the expansion joint assembly comprising:

an upper subassembly;

a lower subassembly;

a co-extrusion element having a compressible EPDM closed cell foam portion and a substantially rigid EPDM rubber portion, the rubber portion affixed to the upper and lower subassemblies, and the foam portion providing a weatherproofing barrier for the expansion joint assembly and being shaped to provide a thermal insulator structure between adjacent glass panels; and a pressure plate covering a width of the expansion joint assembly and providing means for capping said expansion joint assembly.

In some embodiments, the mullion base structure of the first-type mullion comprises at least one groove shaped to receive a portion of the at least one profiled rod element and the curtain wall structure further comprises fasteners locking the profiled rod element and the reinforcement element with respect to the mullion base structure.

In some embodiments, the dual density rubber compound comprises a co-extrusion of an EPDM closed cell foam and a second EPDM material having a rigidity greater than the EPDM closed cell foam, and a EPDM closed cell foam portion of the co-extrusion of the gasket forms a compressible outer portion of the gasket and a second EPDM material portion of the co-extrusion of the gasket forms a rigid inner portion of the gasket.

In some embodiments, a minimum thickness of the EPDM foam portion of the gasket is 8.5 mm and the gasket comprises air cavities in the EPDM closed cell foam to provide insulation of an inner portion of the curtain wall.

In some embodiments, the outer portion of the gasket made of EPDM closed cell forms a planar sealing surface that covers completely at least one face of the second type mullion.

In some embodiments, the outer portion of the gasket made of EPDM closed cell has a width of at least 4 mm wider than the at least one second type mullion, the EPDM closed cell foam portion exceeding the mullion and creating a sealed junction forming a continuous sealing plane throughout a complete thickness of the gasket and the second type mullion.

In some embodiments, the second EPDM material portion of the co-extrusion of the gasket comprises a round portion limiting compression of the EPDM closed cell foam portion due to varying wind loads.

In some embodiments, the gasket comprises a T-shaped portion and defines an internal air cavity.

In some embodiments, the curtain wall structure further includes a guide rod for temporarily keeping proper joint alignment and/or gapping of relative positions of the upper and lower subassemblies during installation of the expansion joint assembly and being removable from the assembly following said installation.

In some embodiments, the curtain wall structure further includes a membrane for covering an insertion aperture formed in the joint assembly after removal of the guide rod.

In some embodiments, the curtain wall structure further includes a membrane for covering a junction of two horizontal expansion joint assemblies.

In some embodiments, the upper and lower subassemblies are shaped to allow relative displacement therebetween of at least about 38 mm.

In some embodiments, a maximum height of the expansion joint assembly is about 95 mm in a neutral position and about 114 mm when fully expanded.

In some embodiments, the expansion joint assembly is shaped to prevent disassembly from occurring within a vertical displacement greater than 38 mm.

In some embodiments, the upper subassembly and the lower subassembly of the expansion joint assembly contact through at least one expansion joint gasket and wherein sliding movement between the upper and lower subassemblies is done via said at least one expansion joint gasket.

In some embodiments, the curtain wall structure further includes an exterior pressure strip that is visible and utilizes a same covering profile as a standard mullion.

In some embodiments, the expansion joint assembly is configured to have an inertia that is substantially similar to an inertia of a standard mullion of comparable depth.

In some embodiments, the water drainage cross element assembly further comprises a third adapter subelement for the use of the cross element assembly within an expansion mullion assembly.

In some embodiments, the first and second cross subelements are angularly adjustable one with respect to the other through an angular adjustment mechanism.

In some embodiments, the angular adjustment mechanism comprises two oval apertures allowing angular relative displacement between the first and second cross subelements upon application and removal of cross subelement fasteners therebetween.

In some embodiments, the elastomeric element is made of a rubber compound.

In some embodiments, the elastomeric element is substantially square shaped and comprises at least one aperture allowing water drainage and at least one hole shaped to receive an attachment screw.

In some embodiments, the cross element assembly further includes at least one notch in a bottom portion thereof.

In some embodiments, each cross subelement comprises at least two notches on an exterior portion of the cross subelement for alignment of an end of the associated cross pressure strip.

In some embodiments, the cross element fasteners, once inserted, are used for the alignment of the cross pressure strip.

In some embodiments, each cross subelement comprises curved portions on an interior portion thereof for providing sealing upon compression of the elastomeric element.

In some embodiments, each subelement comprises at least two positioning pins on the interior portion, the positioning pins having a stepped diameter for limiting compression in the elastomeric element.

In some embodiments, the cross pressure strip comprises at least one aperture allowing water drainage and at least one hole shaped to receive an attachment screw.

In some embodiments, the cross pressure strip further comprises at least one groove allowing passage of air, the cross pressure strip further comprising at least two grooved shapes on a perimeter thereof for receiving a cover.

In some embodiments, the curtain wall structure further includes a cross finishing cap covering subcomponents of the cross element assembly.

In some embodiments, the curtain wall structure further includes a replacement component for allowing use of the cross element assembly with an angled corner mullion.

In some embodiments, the curtain wall structure further includes a contour adapter component for allowing use of the cross element assembly on a perimeter of a curtain wall assembly.

In some embodiments, the curtain wall structure further includes an expansion subelement for allowing use of the cross element assembly with an expansion mullion assembly having also a vertical mullion.

In some embodiments, the rod element of the first-type mullion has a first portion insertable in a retaining groove in the mullion structure and a second portion supporting the steel reinforcement element.

In some embodiments, the curtain wall structure further includes a fixation screw insertable in the retaining groove at each extremity of the mullion structure, the screw compressing the rod element.

According to the present invention, there is also provided a dual density gasket for mounting glass panels of a curtain wall comprising a first rubber compound and a second rubber compound.

In some embodiments, the gasket is formed from a co-extrusion of an EPDM closed cell foam and a second EPDM material having a rigidity greater than the EPDM closed cell foam, and wherein a EPDM closed cell foam portion of the co-extrusion forms a compressible outer portion of the gasket and a second EPDM material portion of the co-extrusion forms a rigid inner portion of the gasket.

In some embodiments, a minimum thickness of the EPDM foam portion of the gasket is 8.5 mm and the gasket comprises air cavities in the EPDM closed cell foam to provide insulation of an inner portion of the curtain wall.

In some embodiments, the outer portion of the gasket made of EPDM closed cell forms a planar sealing surface that covers completely at least one face of the mullion.

In some embodiments, the outer portion of the gasket made of EPDM closed cell as a width of at least 4 mm wider than the mullion, the EPDM closed cell foam portion exceeding the mullion and creating a sealed junction forming a continuous at a sealing plane and throughout a complete thickness of the gasket and the second type mullion.

In some embodiments, the second EPDM material portion of the co-extrusion of the gasket comprises a round portion limiting the compression of the EPDM close cell foam portion due to varying wind loads.

In some embodiments, the gasket comprises a T-shaped portion and defines an internal air cavity.

According to the present invention, there is also provided an expansion joint assembly for a curtain wall comprising:

- an upper subassembly;
- a lower subassembly;
- a co-extrusion element having a compressible EPDM closed cell foam portion and a substantially rigid EPDM rubber portion, the rubber portion affixed to the upper and lower subassemblies, and the foam portion providing a weatherproofing barrier for the expansion joint assembly and being shaped to provide a thermal insulator structure between adjacent glass panels and
- a pressure plate covering a width of the expansion joint assembly and providing means for capping said expansion joint assembly.

In some embodiments, the expansion joint assembly further includes a guide rod for temporarily keeping proper joint alignment and/or gapping of relative positions of the upper and lower subassemblies during installation of the expansion joint assembly and being removable from the assembly following said installation.

In some embodiments, the expansion joint assembly further includes a membrane for covering an insertion aperture formed in the joint assembly after removal of the guide rod.

In some embodiments, the expansion joint assembly further includes a membrane for covering a junction of two horizontal expansion joint assemblies.

In some embodiments, the upper and lower subassemblies are shaped to allow relative displacement therebetween of at least about 38 mm.

In some embodiments, a maximum height of the expansion joint assembly is about 95 mm in a neutral position and about 114 mm when fully expanded.

In some embodiments, the expansion joint assembly is shaped to prevent disassembly from occurring within a vertical displacement greater than 38 mm.

In some embodiments, the upper subassembly and the lower subassembly contact through at least expansion joint gasket and wherein sliding movement between the upper and lower subassemblies is done via said at least one expansion joint gasket.

In some embodiments, the expansion joint assembly further includes an exterior pressure strip that is visible and utilizes a same covering profile as a standard mullion.

In some embodiments, the expansion joint assembly is configured to have an inertia that is substantially similar to an inertia of a standard mullion of comparable depth.

According to the present invention, there is also provided a curtain wall water drainage cross element assembly comprising:

- a first cross subelement;
- a second transverse cross subelement positionable over the first cross element;
- a third adapter subelement for the use of the cross element assembly within an expansion mullion assembly;
- an elastomeric element positionable over the first and second cross subelements;
- a cross pressure strip positionable over the elastomeric element; and
- a fastening mechanism for fastening the first and second cross subelements, the elastomeric element and the pressure strip together, the pressure strip exerting pressure over the elastomeric element and forming a sealed assembly.

In some embodiments, the first and second cross subelements are angularly adjustable one with respect to the other through an angular adjustment mechanism.

In some embodiments, the angular adjustment mechanism comprises two oval apertures allowing angular relative displacement between the first and second cross subelements upon application and removal of cross subelement fasteners therebetween.

In some embodiments, the elastomeric element is made of a rubber compound.

In some embodiments, the elastomeric element is substantially square shaped and comprises at least one aperture allowing water drainage and at least one hole shaped to receive an attachment screw.

In some embodiments, the cross element assembly further includes at least one notch in a bottom portion thereof.

In some embodiments, each cross subelement comprises at least two notches on an exterior portion of the cross subelement for alignment of an end of the cross pressure strip.

In some embodiments, the cross-element fasteners are used for the alignment of the pressure strip.

In some embodiments, each cross subelement comprises curved portions on an interior portion thereof for providing sealing upon compression of the elastomeric element.

In some embodiments, each subelement comprises at least two positioning pins on the interior portion. The positioning pins also possess two diameters for limiting the compression in the gasket.

In some embodiments, the cross pressure strip comprises at least one aperture allowing water drainage and at least one hole shaped to receive an attachment screw.

In some embodiments, the pressure strip further comprises at least one groove allowing passage of air, the cross pressure strip further comprising at least two grooved shapes on a perimeter thereof for receiving a cover.

In some embodiments, the cross element assembly further includes a cross finishing cap covering subcomponents of the cross element assembly.

In some embodiments, the cross element assembly further includes a replacement component for allowing use of the cross element assembly with an angled corner mullion.

In some embodiments, the cross element assembly further includes a contour adapter component for allowing use of the cross element assembly on a perimeter of a curtain wall assembly.

In some embodiments, the cross element assembly further includes an expansion subelement for allowing use of the cross element assembly with an expansion mullion assembly having also a vertical mullion.

According to the present invention, there is also provided a structurally reinforced mullion of a curtain wall comprising:

- a mullion structure;
- a structural reinforcement element positioned within the mullion structure; and
- at least one rod element supporting the steel reinforcement element with respect to the mullion structure.

In some embodiments, the rod element has a first portion insertable in a retaining groove in the mullion structure and a second portion supporting the steel reinforcement element.

In some embodiments, the structurally reinforced mullion further includes a fixation set screw threaded in the retaining groove on each extremity of the mullion structure, the screw compressing the rod element.

Some objects, advantages and other features will become more apparent upon reading the following non-restrictive description of certain optional configurations, given for the purpose of exemplification only, with reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Furthermore, although the present invention may be used for curtain walls, for example, it is understood that it may be used for other types of wall systems as well.

In addition, although the optional configurations as illustrated in the accompanying drawings comprise various components and although the optional configurations of the curtain wall elements as shown may consist of certain geometrical configurations as explained and illustrated herein, not all of these components and geometries are essential and thus should not be taken in their restrictive sense, i.e. should not be taken as to limit the scope of the present disclosure. It is to be understood that other suitable components and cooperations therein between, as well as other suitable geometrical configurations may be used for the curtain wall elements, and corresponding parts, as briefly explained and as can be easily inferred herefrom, without departing from the scope of the disclosure.

Continuous Sealing Plane—Dual Density Gasket

Figure 1:
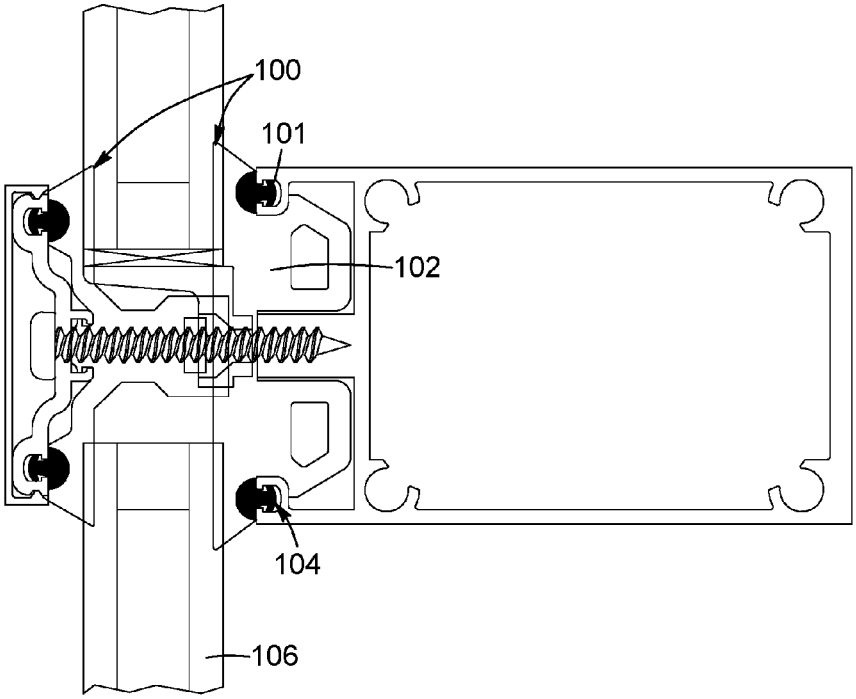
FIG. 1 is a side cross-sectional view of a gasket for a mullion, in accordance with an embodiment of the present invention.

Referring to FIG. 1, according to a first embodiment of the present invention, there is shown a dual density gasket 100 preferably made of rigid and compressible rubber compounds, preferably including an EPDM closed cell foam outer portion 102 co-extruded with a rigid inner portion 101 made of EPDM or any combination of rubber components. Any other materials that are equivalent to rubber compounds or components can also be used. The rigid portion includes two clipping assemblies 104 that fit into aluminum grooves and prevents the gasket from coming off. In addition, the rigid portion limits the compression due to wind loads on the glass or panel surface and any elongation due to thermal expansion or stretching and due to movements caused by shifts in the building structure. The EPDM closed cell foam portion 102 has a flat surface which provides a continuous planar barrier to water and air, which is continuous with respect to the surface of the mullion and covering the whole surface of the mullion. Air cavities in the closed cell foam provide better insulation in addition to reducing the cost of manufacturing. The foam outer portion is compressible against the inner portion and thus can form a sealing barrier. The T-shaped gasket 100 can compartmentalize the area between the two insulating glass panes 106, as the cavities provide means of water and air control within the system, thus providing, through compartmentation, controlled water drainage and an improvement in the overall thermal performance of the system.

The gasket 100 can thus offer the following advantages.

Sealing Properties

- A continuous sealing plane in front of the curtain wall mullion that is coplanar with the inner face of the sealed panels (usually glass units or insulated backpane assemblies or any built up transparent or opaque panel) and provided by the dual density gasket of rigid and compressible rubber compounds.
- Sealing of screw fasteners achieved by inserting the head of custom-designed screws into the dual density gasket.
- Air and water weatherproofing by means of the compression of the dual density foam.

Provides for air and water weatherproofing using specifically designed gaskets on both the inside aluminum profiles making up the expansion joint and the specific pressure plate presenting a mechanical expansion assembly allowing for a vertical displacement of up to about 38 mm.

Air and water weatherproofing by means of a compressed dual density gasket portion around the periphery of the water drainage system (see the example of the water drainage cross elements detailed further below).

Sealing of cross joints of the curtain wall is provided by a compression of the compressible portions of the dual density gaskets which abut one on another and compress by up to about 5 mm, without the need to add a sealant.

Thermal Insulation Properties

The dual density gasket is custom designed to provide insulation on an inner portion of the gasket with air cavity completely covering the support surface of the mullion, with a total depth of about 25.3 mm.

The dual density gasket is custom designed to provide insulation on an outer portion with air cavity which can be clipped on the pressure strip and having a total depth of about 35.8 mm.

The aluminum portion of the mullion is designed in a manner such that it has the ability to accept the screws holding the pressure plate (or any other external means of holding down the glass units, thus keeping intact and not breaking the insulation assembly, as none of the surfaces of either the mullion or pressure plate is exposed to the drained cavity.

Structural Reinforcement for Mullion

Figure 2:
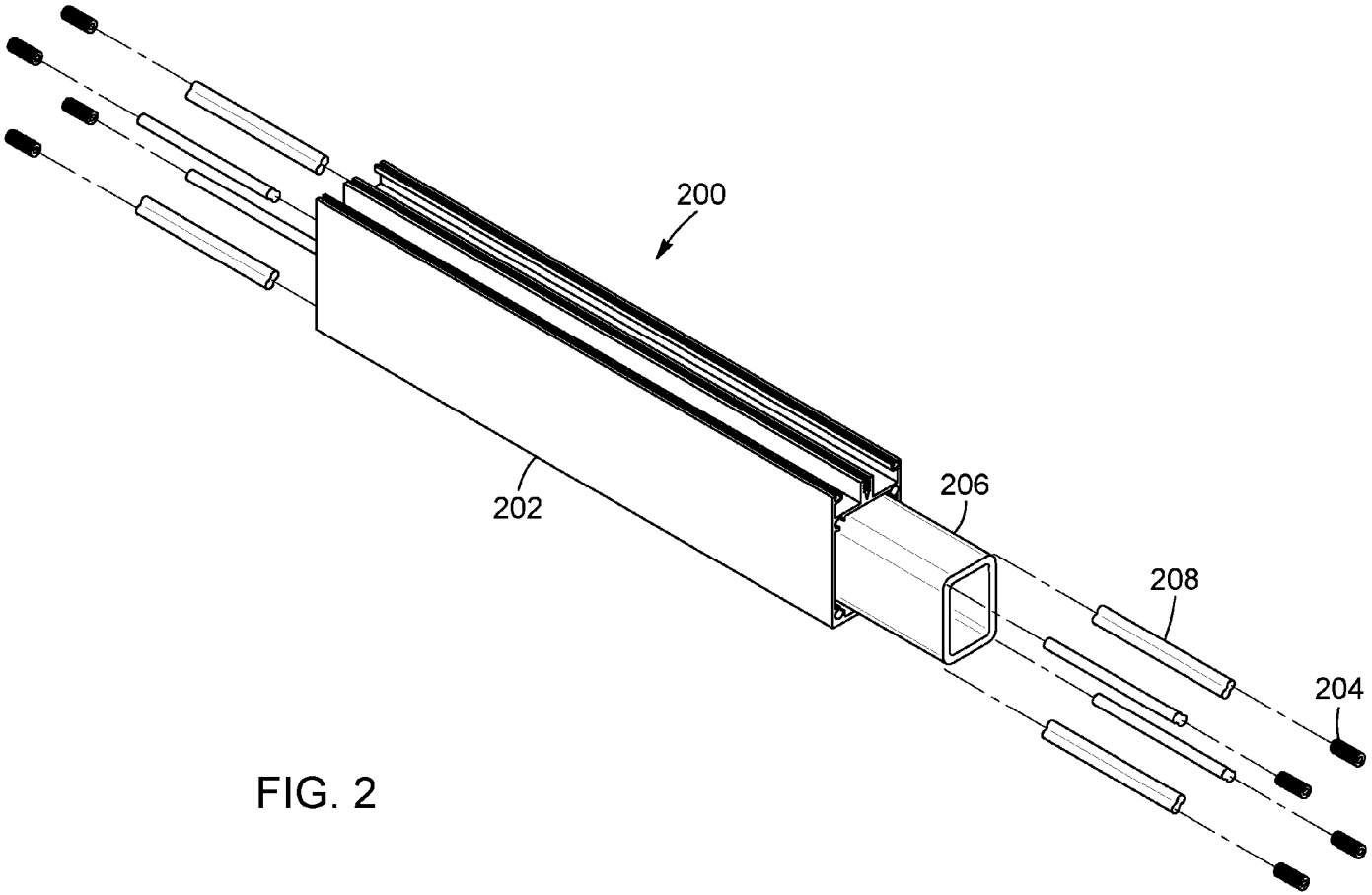
FIG. 2 is an exploded perspective view of a steel reinforcement for a mullion, in accordance with an embodiment of the present invention.

Referring to FIG. 2, a structural reinforcement element assembly 200 integrated into an aluminum mullion 202 is shown. The profile of the extruded aluminum mullion section 202 includes a specially designed groove both for guiding a reinforcement element 206 (made of, for example, HSS (hollow structural steel)) in addition to receiving set screws 204 installed to lock in place the steel/aluminum rod elements and an aluminum retaining rod 208 (shaped as an 8 figure) such that the arrangement of these elements locks the reinforcement element to the aluminum mullion, thus providing an increased structural capacity of the assembly. A portion of the rod is inserted into the specially designed groove and the second remains outside, but is used to support the reinforcement element 206. The aluminum rods 208 are used to fill the space between the set screws and the reinforcement element 206 which is never as long as the aluminum mullion 202. The reinforcement element 206 can be made of numerous materials, including, but not limited to, standard structural steel, bent shapes made of either steel or aluminum, custom and standard extruded aluminum profiles, pultruded composites profiles, and other materials having similar properties. The reinforcement element 206 is locked in placed such that the total inertia of the system is increased in order to achieve a better load bearing capacity.

The reinforcement element assembly 200 can thus offer the following advantages:

Help provide an aluminum mullion with a grooved profile specially designed to guide and support a complementary steel reinforcement element. The dimensions can vary depending on the overall depth of the mullions (108 to 211 mm)

Fixing of the reinforcement inside the aluminum mullion is achieved with a series of specially profiled shapes inserted into integral guiding grooves. The reinforcement element inserted in the curtainwall backmember is locked in place by the specially profiled shapes. These profiled shapes are locked in position in the grooves by means of compression via set screws that are threaded from either end of the grooves. Depending on the materials used, a weldment could also serve as a means to lock the profiled shape to the backmember.

Water Drainage Cross Element

Figure 3:
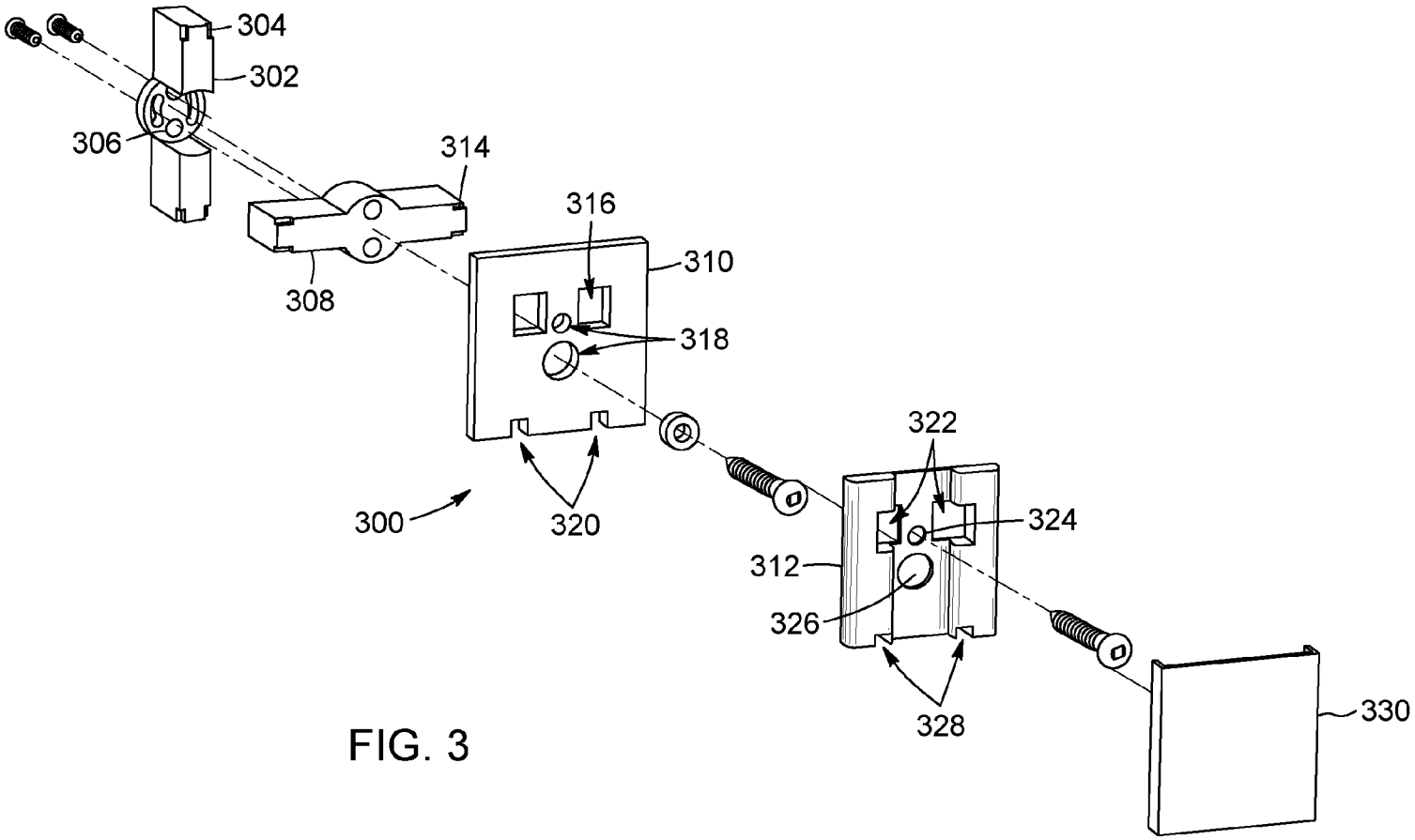
FIG. 3 is an exploded view of a water drainage cross element for a mullion, in accordance with an embodiment of the present invention.

Referring to FIG. 3, a curtain wall water drainage cross element assembly 300 is shown. The cross element assembly 300 includes a first plastic piece 302 having two grooves 304 on the end thereof to guide alignment of the pressure strips overlapping the piece 302. Two oval holes 306 are also provided to allow fastening the second plastic piece 308 with respect to the first plastic piece at angles ranging from plus to minus 30 degrees. Two vertically aligned holes are used to secure the assembly of the two pieces 302,308 forming the cross element, the closed cell foam element 310 and the pressure strip 312, on the screwing base of the curtain wall. The second plastic piece 308 is screwed at a desired angle with respect to the first piece 302 and is used to carry water from horizontal struts. This second piece 308 also has guiding grooves 314 for guiding pressure strips. An EPDM closed cell foam element 310 having a substantial square shape with two apertures 316 to allow drainage of water by gravity and two holes 318 for the passage of attachment screws. Two small notches 320 in the bottom allow the entry of air into the element 300. An aluminum pressure strip 312 is also provided. This strip 312 also has two water drainage apertures 322, a hole 324 for screwing in the mullion and a hole 326 to provide clearance for the head of the screw affixing the cross element. This strip 312 compresses cell foam element 310 to seal the assembly 300. The pressure strip 312 also includes two grooves 328 to let in air. The assembly 300 allows water within the system to drain out and descend down the vertical pressure strips of the lower levels of the wall, outside of the drained cavity, but still under the decorative cap. A finishing cap 330 may also be provided and can have a desired finish applied, which is typically anodized or painted, although its aesthetic appearance may vary, as other finish options can be considered.

Figure 3B:
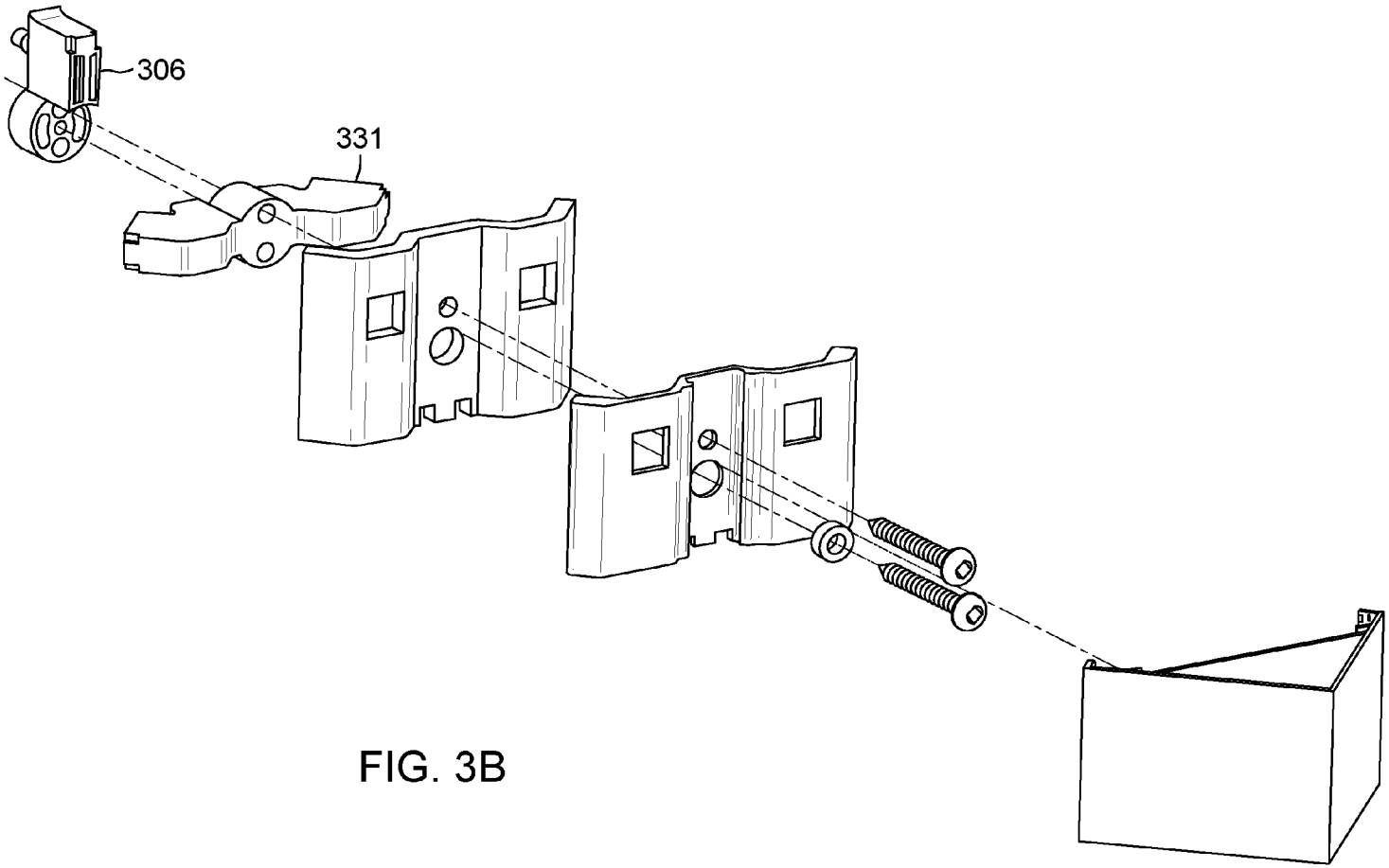
FIG. 3B is an exploded view of a water drainage cross element for a corner mullion, in accordance with another embodiment of the present invention.

The water drainage cross element 300 can thus offer the following advantages:

molded plastic assembly located at the junction of the horizontal and vertical struts of mullions to compartmentalize the flow of water in front of the water and air sealing plane. The assembly prevents water from flowing vertically inside the curtain wall system. The cross element assembly allows the water accumulated in the horizontal and vertical struts to drain between the pressure strips and the finishing cap through drainage channels.

the cross element assembly is concealed and invisible from the outside.

the cross element assembly allows self-alignment of vertical and horizontal pressure strips by means of a small groove which allows alignment during installation of the retaining strips (pressure plate).

the cross element assembly includes two detachable parts that allow pivoting to ensure that the sealing and drainage functions between panels positioned at up to more or less about 30 degree offsets with respect to right angles.

as better shown in FIG. 3B, a horizontal replacement piece 331 allows the cross element assembly to provide a sealing and drainage function in a configuration of an angled corner mullion. Hence, specific parts can provide means of adapting the principle of the water drainage cross element to various corner angles.

Expansion Joint

Figure 4:
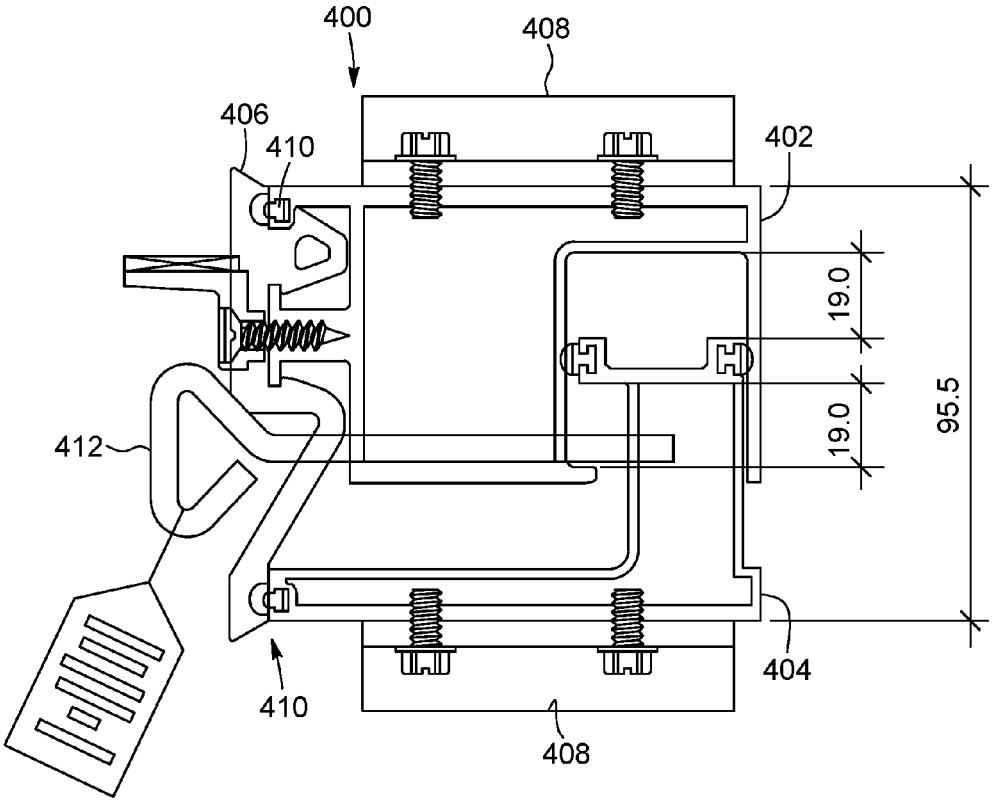
FIG. 4 is a side cross-sectional view of an expansion joint, in accordance with an embodiment of the present invention.

Referring to FIG. 4, an expansion joint assembly 400 is shown. The joint assembly 400 includes an upper aluminum subassembly 402 which is designed to allow vertical displacement of up to about 38 mm. The assembly 400 has a standard screw strip and a clip assembly for an EPDM foam element. The joint assembly 400 is designed such as to have a substantially comparable inertia of a standard mullion having a comparable depth. A lower aluminum subassembly 404 of the expansion joint is also provided. The subassembly 404 is attached to the top end of the vertical mullions just underneath the expansion joint and serves to support the upper assemblies. A sliding system with a seal gasket allows the vertical displacement of two aluminum subassemblies without any loss of leak tightness. The subassembly 404 also includes a clipping interface to attach to a common EPDM foam extrusion. A standard anchoring interface 408 to the curtain wall is pre-installed on the upper and lower subassemblies 402,404 to allow alignment of vertical mullions from one floor to another. An EPDM closed cell foam co-extrusion element with EPDM rubber 406 is also provided. The rigid rubber portion includes two clipping interfaces for fixing the coextruded element 406 on the upper and lower subassemblies 402, 404 of the expansion joint. The EPDM closed cell foam portion 406 is used for air and water weatherproofing of the expansion joint. Moreover, the EPDM closed cell foam is a thermal insulator for the portion between the two insulating glass panels. A guide rod 412 can also be provided to keep the expansion joint in the correct position during installation. Once installed, the rod 412 is removed and the insertion hole is covered with a self-adhesive waterproof membrane.

The expansion joint assembly 400 can thus offer the following advantages:

- aluminum subassemblies designed as two movable parts allowing a vertical displacement of about 38 mm. The expansion joint profile is designed to be used for the full width of the curtain wall, with a dominant horizontal assembly having a fastening system for aligning vertical mullions.
- the subassemblies are interlocked and cannot be separated beyond the designed 38 mm allowable displacement.
- temporary positioning rods ensure proper alignment during installation of the expansion joint, and the rods are removed once the curtain wall grid is secured on the structure of the building.
- expansion joint caps can be the same finishing caps used in standard curtain walls.
- the expansion joints have a substantially same inertia as that of a standard mullion.
- This type of joint provides a sound free vertical displacement of components by means of no direct metal to metal contact between sliding parts.
- Joint can be located near or at anchoring level without transferring bending moments within the joint assembly.

Of course, the scope of the claims should not be limited by the preferred embodiments set forth in the examples, but should be given the broadest interpretation consistent with the description as a whole. Numerous modifications could be made to the above-described embodiments without departing from the scope of the claims, as apparent to a person skilled in the art. Furthermore, it is apparent that this invention can apply to many other uses.

The invention claimed is:

1. A curtain wall structure comprising:

at least one first-type mullion comprising:

a mullion base structure;

a structural reinforcement element positioned within the mullion base structure; and at least one profiled rod element retaining the structural reinforcement element with respect to the mullion base structure; and at least one second-type mullion comprising:

a gasket for mounting glass panels of the curtain wall structure, the gasket being formed from a dual density rubber compound;

wherein each mullion of a curtain wall daylight opening comprises a water drainage cross element assembly, the cross element assembly comprising:

a first cross subelement;

a second transverse cross subelement positionable over the first cross element;

an elastomeric element positionable over the first and second cross subelements;

a cross pressure strip positionable over the elastomeric element; and a fastening mechanism for fastening the first and second cross subelements, the elastomeric element and the pressure strip together, the pressure strip exerting pressure over the elastomeric element and forming a sealed assembly, wherein the first cross subelement is angularly adjustable relative to the second cross subelement through an angular adjustment mechanism.

2. The curtain wall structure according to claim 1, further comprising an expansion joint assembly, the expansion joint assembly comprising:

an upper subassembly;

a lower subassembly;

a co-extrusion element having a compressible EPDM closed cell foam portion and a substantially rigid EPDM rubber portion, the rubber portion affixed to the upper and lower subassemblies, and the foam portion providing a weatherproofing barrier for the expansion joint assembly and being shaped to provide a thermal insulator structure between adjacent glass panels; and a pressure plate covering a width of the expansion joint assembly and providing means for capping said expansion joint assembly.

3. The curtain wall structure according to claim 1, wherein the mullion base structure of the first-type mullion comprises at least one groove shaped to receive a portion of the at least one profiled rod element and the curtain wall structure further comprises fasteners locking the profiled rod element and the reinforcement element with respect to the mullion base structure.

4. The curtain wall structure according to claim 1, wherein the dual density rubber compound comprises a co-extrusion of an EPDM closed cell foam and a second EPDM material having a rigidity greater than the EPDM closed cell foam, and a EPDM closed cell foam portion of the co-extrusion of the gasket forms a compressible outer portion of the gasket and a second EPDM material portion of the co-extrusion of the gasket forms a rigid inner portion of the gasket.

5. The curtain wall structure according to claim 4, wherein a minimum thickness of the EPDM foam portion of the gasket is 8.5 mm and the gasket comprises air cavities in the EPDM closed cell foam to provide insulation of an inner portion of the curtain wall.

6. The curtain wall structure according to claim 4, wherein the outer portion of the gasket made of EPDM closed cell forms a planar sealing surface that covers completely at least one face of the second type mullion.

7. The curtain wall structure according to claim 4, wherein the outer portion of the gasket made of EPDM closed cell has a width of at least 4 mm wider than the at least one second type mullion, the EPDM closed cell foam portion exceeding the mullion and creating a sealed junction forming a continuous sealing plane throughout a complete thickness of the gasket and the second type mullion.

8. The curtain wall structure according to claim 4, wherein the second EPDM material portion of the co-extrusion of the gasket comprises a round portion limiting compression of the EPDM closed cell foam portion due to varying wind loads.

9. The curtain wall structure according to claim 4, wherein the gasket comprises a T-shaped portion and defines an internal air cavity.

10. The curtain wall structure according to claim 2, further comprising a guide rod for temporarily keeping proper joint alignment and/or gapping of relative positions of the upper and lower subassemblies during installation of the expansion joint assembly and being removable from the assembly following said installation.

11. The curtain wall structure according to claim 10, further comprising a membrane for covering an insertion aperture formed in the joint assembly after removal of the guide rod.

12. The curtain wall structure according to claim 10, further comprising a membrane for covering a junction of two horizontal expansion joint assemblies.

13. The curtain wall structure according to claim 10, wherein a maximum height of the expansion joint assembly is about 95 mm in a neutral position and about 114 mm when fully expanded.

14. The curtain wall structure according to claim 2, wherein the expansion joint assembly is shaped to prevent disassembly from occurring within a vertical displacement greater than 38 mm.

15. The curtain wall structure according to claim 2, wherein the upper subassembly and the lower subassembly of the expansion joint assembly contact through at least one expansion joint gasket and wherein sliding movement between the upper and lower subassemblies is done via said at least one expansion joint gasket.

16. The curtain wall structure according to claim 10, further comprising an exterior pressure strip that is visible and utilizes a same covering profile as a standard mullion.

17. The curtain wall structure according to claim 10, wherein the expansion joint assembly is configured to have an inertia that is substantially similar to an inertia of a standard mullion of comparable depth.

18. The curtain wall structure according to claim 1, wherein the angular adjustment mechanism comprises two oval apertures allowing angular relative displacement between the first and second cross subelements upon application and removal of cross subelement fasteners therebetween.

19. The curtain wall structure according to claim 1, wherein the elastomeric element is substantially square shaped and comprises at least one aperture allowing water drainage and at least one hole shaped to receive an attachment screw.

20. The curtain wall structure according to claim 19, wherein the cross element assembly further comprises at least one notch in a bottom portion thereof.

21. The curtain wall structure according to claim 1, wherein each cross subelement comprises at least two notches on an exterior portion of the cross subelement for alignment of an end of the associated cross pressure strip.

22. The curtain wall structure according to claim 18, wherein the cross subelement fasteners, once inserted in the oval apertures, are used for the alignment of the cross pressure strip.

23. The curtain wall structure according to claim 1, wherein each cross subelement comprises curved portions on an interior portion thereof for providing sealing upon compression of the elastomeric element.

24. The curtain wall structure according to claim 1, wherein each cross subelement comprises at least two positioning pins on an interior portion of said cross subelement.

25. The curtain wall structure according to claim 1, wherein the cross pressure strip comprises at least one aperture allowing water drainage and at least one hole shaped to receive an attachment screw.

26. The curtain wall structure according to claim 1, wherein the cross pressure strip further comprises at least one groove allowing passage of air, the cross pressure strip further comprising at least two grooved shapes on a perimeter thereof for receiving a cover.

27. The curtain wall structure according to claim 1, further comprising a cross finishing cap covering subcomponents of the cross element assembly.

28. The curtain wall structure according to claim 1, wherein the rod element of the first-type mullion has a first portion insertable in a retaining groove in the mullion base structure and a second portion supporting a steel reinforcement element.

29. The curtain wall structure according to claim 28, further comprising a fixation screw insertable in the retaining groove at each extremity of the mullion base structure, the screw compressing the rod element.

* * * * *